US006777633B2

(12) United States Patent
Kondo et al.

(10) Patent No.: US 6,777,633 B2
(45) Date of Patent: Aug. 17, 2004

(54) SWITCH DEVICE

(75) Inventors: Hirofumi Kondo, Aichi (JP); Motoharu Yoshida, Aichi (JP); Mamoru Miyako, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 37 days.

(21) Appl. No.: 10/366,391

(22) Filed: Feb. 14, 2003

(65) Prior Publication Data

US 2003/0155225 A1 Aug. 21, 2003

(30) Foreign Application Priority Data

Feb. 20, 2002 (JP) ..... P2002-043613

(51) Int. Cl.[7] ..... H01H 9/00
(52) U.S. Cl. ..... 200/310; 200/341
(58) Field of Search ..... 200/310–314, 200/329, 330, 341, 520, 518, 5 A, 5 D, 5 E

(56) References Cited

U.S. PATENT DOCUMENTS 4,458,124 A 7/1984 Kroth et al. ..... 200/311
4,635,167 A * 1/1987 Schlosser ..... 362/85
5,731,558 A 3/1998 Kyoden ..... 200/5
5,952,628 A * 9/1999 Sato et al. ..... 200/4
6,084,189 A 7/2000 Menche et al. ..... 200/315
6,299,320 B1 * 10/2001 Kato et al. ..... 362/23
6,667,451 B1 * 12/2003 Hart ..... 200/314

FOREIGN PATENT DOCUMENTS

EP 1 164 607 A2 12/2001
JP 2242572 A * 10/1991 ..... H01H/13/70
JP 05182560 A * 7/1993 ..... H01H/13/02
JP 08129935 5/1996

* cited by examiner

*Primary Examiner*—Lincoln Donovan
*Assistant Examiner*—Lisa Klaus
(74) *Attorney, Agent, or Firm*—Morgan, Lewis & Bockius LLP

(57) ABSTRACT

A light guide member (35) is made of a transparent material, and includes a main body portion (35*a*), disposed at a back side of a central portion of an operating member (2), and extension portions (35*d*, 35*e*) which extend from the main body portion, and are disposed respectively at back sides of push operating portions (8, 9). This light guide member is separate from the operating member (2), and light emitted from LEDs (66) passes sequentially through the main body portion (35*a*) of the light guide member (35) and the extension portions (35*d*, 35*e*) to illuminate light-transmitting indicating portions (12, 13) of the operating member.

2 Claims, 5 Drawing Sheets

SWITCH DEVICE

BACKGROUND OF THE INVENTION

This invention relates to a switch device including an operating member which has push operating portions, provided respectively at four portions of a peripheral portion thereof, and light-transmitting indicating portions provided respectively at these push operating portions.

One known conventional switch device for a vehicle such as an automobile includes an operating member having push operating portions, provided respectively at four portions of a peripheral portion thereof, and light-transmitting indicating portions provided respectively at these push operating portions. In this switch device, a light guide member is provided at a back side of the operating member, and this light guide member can be guided by a guide member in four directions corresponding respectively to pushing operations of the push operating portions.

Pushers are provided respectively at the back sides of the push operating portions of the operating member, and can be pushed by these push operating portions, respectively, and switching elements can be pressed and operated by these pushers, respectively.

A light source is provided beyond the light guide member, and in accordance with an operation of a light control switch (not shown), light emitted from this light source permeates the light guide member, and illuminates the light-transmitting indicating portions of the operating member.

In the above conventional construction, the light guide member is common to the four light-transmitting indicating portions of the operating member, and in this connection, this light guide member is disposed at the back side of the operating member, and more specifically at a central portion of the back side of the operating member. One reason for this is that each of the switching elements must be located at a position toward which the corresponding push operating portion is operated, so that an operating load produced upon pushing of each push operating portion of the operating member can be transmitted via the corresponding pusher to the corresponding switching element without any loss, and another reason is that the switching elements can not be located at other positions than such positions because of a limited space, and therefore the light guide member need to be provided so as not to interfere with them.

The light guide member thus functions to allow light, emitted from the light source, to pass therethrough so as to illuminate the light-transmitting indicating portions of the operating member as described above, and therefore it has been proposed to provide this light guide member integrally with the light-transmitting indicating portions of the operating member. In this case, generally, each light-transmitting indicating portion of the operating member is made of a translucent resin having milk white color or the like, while the body of the operating member is made of a light-blocking resin. Therefore, when the light guide member is provided integrally with the light-transmitting indicating portions, this light guide member is also made of such a translucent resin.

However, when the light guide member is made of such a translucent resin, light emitted from the light source does not reach the light-transmitting indicating portions of the operating member, and as a result the light-transmitting indicating portions will not be illuminated.

On the other hand, it has been proposed to form the light guide member from a transparent resin. In this case, light emitted from the light source can sufficiently reach each light-transmitting indicating portion of the operating member. In this case, however, each light-transmitting indicating portion of the operating member is also made of the transparent resin, and therefore each light-transmitting indicating portion is so excessively illuminated that its brightness becomes excessively high.

SUMMARY OF THE INVENTION

This invention has been made under the above circumstances, and an object of the invention is to provide a switch device in which a light guide member is provided so as not to interfere with pushers, pushed respectively by four push operating portions of an operating member, and switching elements, and besides light-transmitting indicating portions of the operating member can be illuminated properly.

The above object has been achieved by a switch device of the present invention characterized in that the device comprises an operating member including push operating portions, provided respectively at four portions of a peripheral portion thereof, and light-transmitting indicating portions provided respectively at the push operating portions; a light guide member which is made of a transparent material, and is connected to the operating member, and includes a main body portion, disposed at a back side of a central portion of the operating member, and extension portions which extend from the main body portion, and are disposed respectively at back sides of the light-transmitting indicating portions; a guide member for guiding the light guide member in four directions corresponding respectively to pushing operations of the push operating portions of the operating member; pushers which are provided respectively at back sides of the extension portions of the light guide portion, and can be pushed respectively by the pushing operations of the push operating portions; switching elements which can be pressed and operated by the pushers, respectively; and a light source provided beyond the main body portion of the light guide member; and light, emitted from the light source, passes sequentially through the main body portion of the light guide member and the extension portions to illuminate the light-transmitting indicating portions of the operating member.

In this construction, the light guide member is made of the transparent material capable of sufficiently transmitting light. And besides, this light guide member is separate from the light-transmitting indicating portions of the operating member, and therefore the light-transmitting indicating portions can be made of a translucent material regardless of the material of which the light guide member is made. Therefore, each of the light-transmitting indicating portions can be illuminated with the proper brightness.

DETAILED DESCRIPTION OF PREFERRED EMBODIMENTS

One preferred embodiment of the present invention applied to a cruise-control and radio-control switch device mounted on a steering wheel of a vehicle (particularly an automobile) will be described with reference to the drawings.

Figure 2:
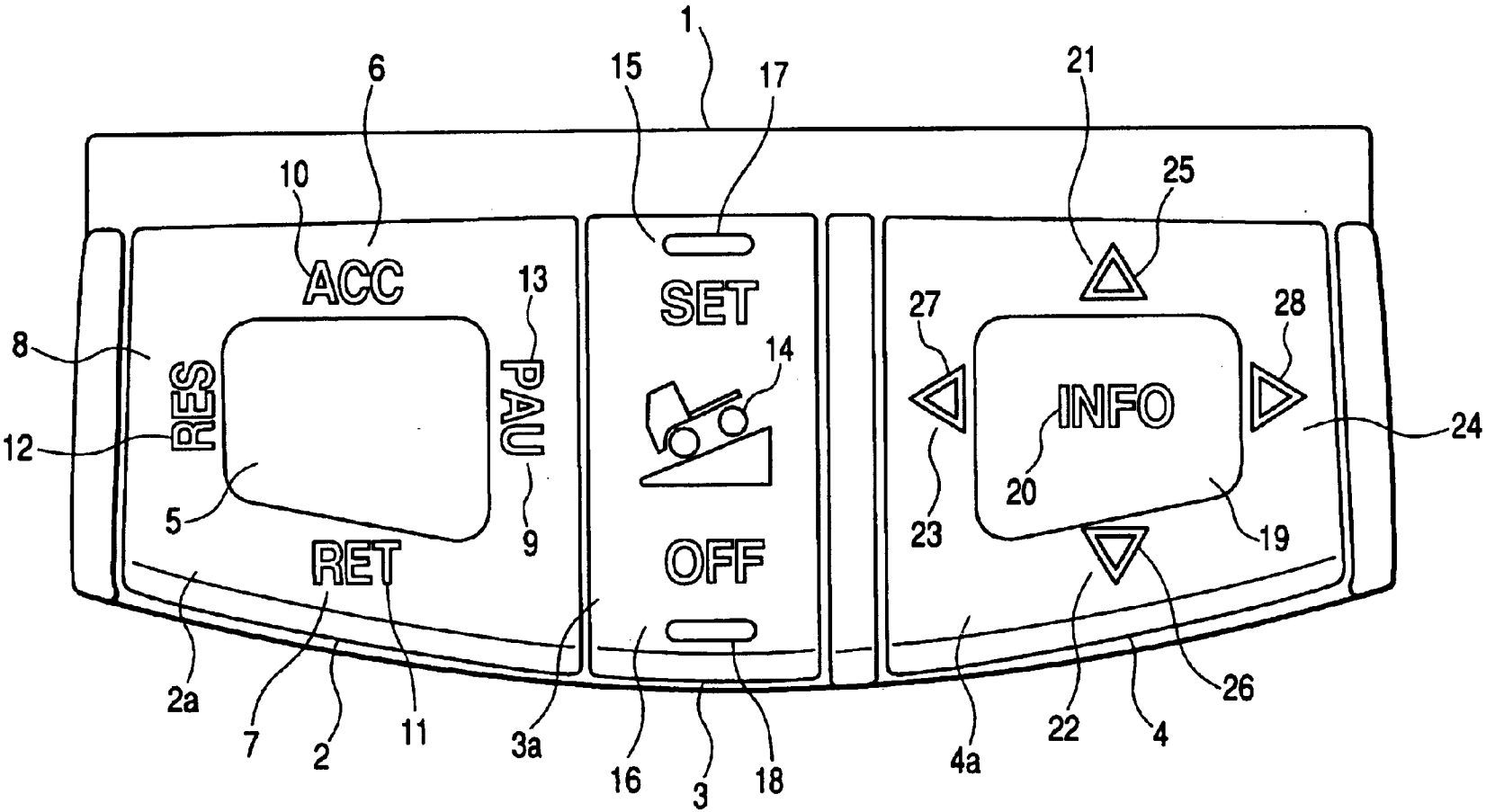
FIG. 2 is a plan view showing the whole of the embodiment.

A body 1 and operating members 2, 3 and 4 mounted on this body are shown in FIG. 2.

The operating member 2 is provided for cruise control purposes, and includes a recess 5 formed in a central portion of an upper surface thereof, push operating portions 6, 7, 8 and 9, provided respectively at four portions (upper, lower, left and right portions in the drawings) of a peripheral portion thereof, and light-transmitting indicating portions 10, 11, 12 and 13 provided respectively at the push operating portions 6 to 9.

The operating member 3 is provided also for cruise control purposes, and includes a light-transmitting indicating portion 14 provided at a central portion thereof, push operating portions 15 and 16, provided at two (upper and lower in the drawings) portions thereof, and light-transmitting indicating portions 17 and 18 provided respectively at the push operating portions 15 and 16.

The operating member 4 is provided for radio control purposes, and includes a recess 19 formed in a central portion of an upper surface thereof, a light-transmitting indicating portion 20, provided at a central portion of this recessed portion 19, push operating portions 21, 22, 23 and 24, provided respectively at four portions (upper, lower, left and right portions in the drawings) of a peripheral portion thereof, and light-transmitting indicating portions 25, 26, 27 and 28 provided respectively at the push operating portions 21 to 24.

The light-transmitting indicating portions 10 to 13, 14, 17, 18, 20 and 25 to 28 of the operating members 2 to 4 are made of a translucent material such as a synthetic resin of milk white color, and bodies 2*a*, 3*a* and 4*a* of the operating members 2 to 4 except these light-transmitting indicating portions are made of a light-blocking material such as a synthetic resin of a light-blocking nature.

Here, the operating member 2 is quite similar to the operating member 4, and their internal structures are also similar to each other, and therefore the operating member 2 will be described below as a representative (The description of the operating member 3 will be omitted).

Figure 3:
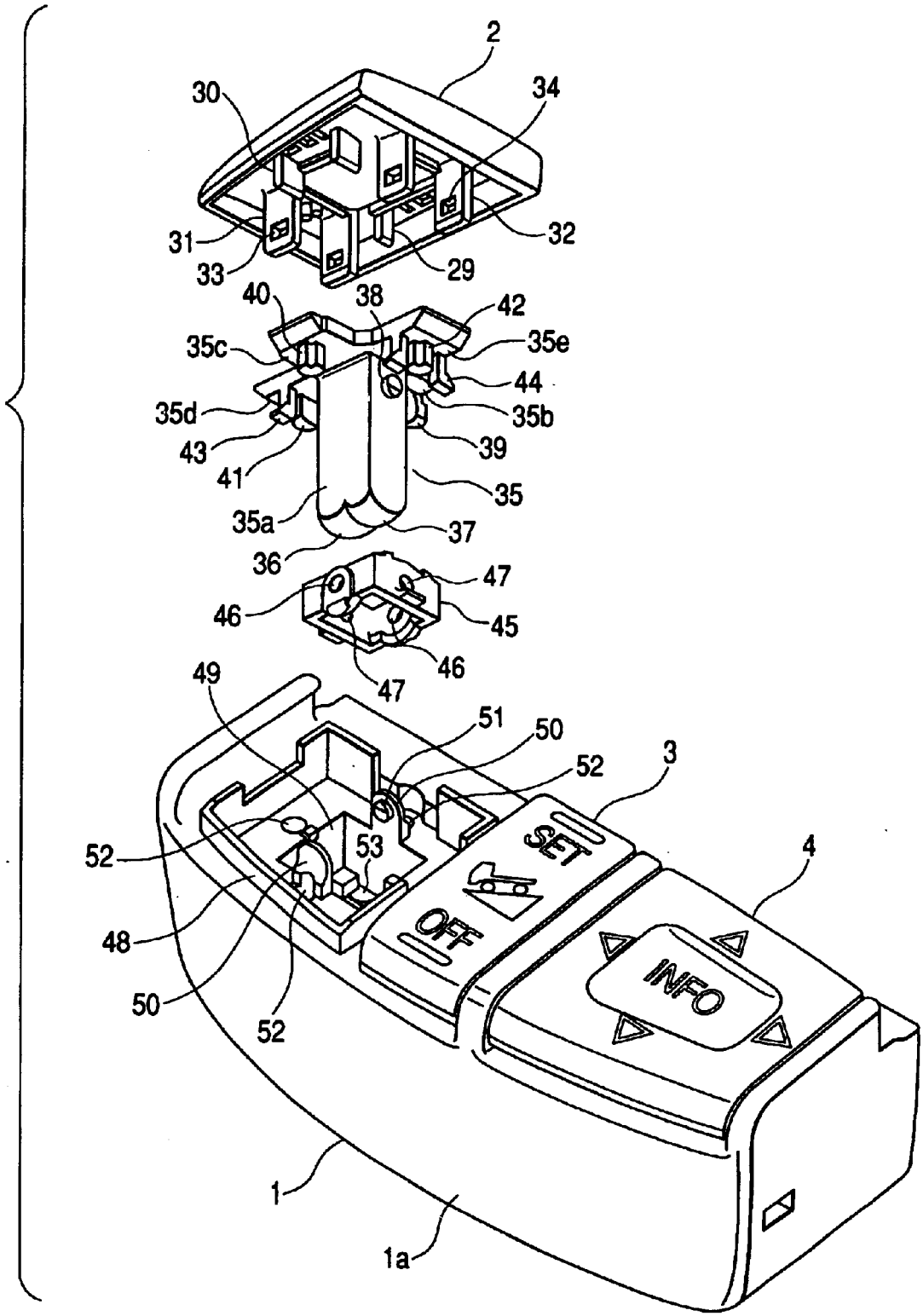
FIG. 3 is an exploded, perspective view showing an important portion.

As shown in FIG. 3, ribs 29, 30, 31 and 32 are formed on a back side of the operating member 2. There are provided two ribs 29, two ribs 30, two ribs 31 and two ribs 32 for the light-transmitting indicating portions 10 to 13, respectively, in such a manner that each light-transmitting indicating portion lies between the corresponding two ribs. Each of the left ribs 31 includes an engagement hole 33 formed through a lower portion thereof, and each of the right ribs 32 includes an engagement hole 34 formed through a lower portion thereof. The left and right ribs 31 and 32 are longer than the front and rear ribs 29 and 30.

Reference numeral 35 denotes a light guide member. This light guide member 35 is separate from the operating member 2, and hence is separate from the light-transmitting indicating portions 10 to 13, and is made of a transparent material such as a transparent synthetic resin. This light guide member includes a main body portion 35*a*, and extension portions 35*b*, 35*c*, 35*d* and 35*e*. The main body portion 35*a* has a square pillar-like configuration, and includes curved convex surfaces 36 and 37 formed at a lower end thereof in a juxtaposed manner. The curved surfaces 36 and 37 are curved in the forward-rearward direction and also in the right-left direction.

Shaft projections 38 having a short cylindrical shape are formed respectively on right and left sides of an upper portion of the main body portion 35*a*, and the extension portions 35*b* to 35*e* extend respectively from the front, rear, left and right sides of the uppermost portion of the main body portion 35*a* disposed above the shaft projections 38. Operating projections 39 and 40 are formed respectively on back sides of the front and rear extension portions 35*b* and 35*c*, and operating projections 41 and 42 are formed respectively on back sides of the left and right extension portions 35*d* and 35*e*, and engagement claws 43 are formed on the back side of the left extension portion 35*d*, and engagement claws 44 are formed on the back side of the right extension portion 35*e*.

In this construction, each of the extension portions 35*b* to 35*e* is fitted into the corresponding pair of ribs 29, 30, 31, 32 from the lower side in such a manner that the engagement claws 43 are engaged respectively in the engagement holes 33 while the engagement claws 44 are engaged respectively in the engagement holes 34, and by doing so, the light guide member 35 is connected to the operating member 2. As a result, the main body portion 35*a* of the light guide member 35 is disposed at the back side of the central portion of the operating member 2, and the extension portions 35*b* to 35*e* are disposed at the back sides of the light-transmitting indicating portions 10 to 13 (and hence at the back sides of the push operating portions 6 to 9), respectively.

Reference numeral 45 denotes a holder. This holder 45 has a rectangular frame-like configuration, and includes shaft receiving holes 46 formed respectively through front and rear side walls thereof, and shaft receiving holes 47 formed respectively through left and right side walls thereof. This holder 45 is fitted on the main body portion 35*a* of the light guide member 35 from the lower side, and the shaft receiving holes 47 are pivotally fitted on the shaft projections 38, respectively.

Figure 4:
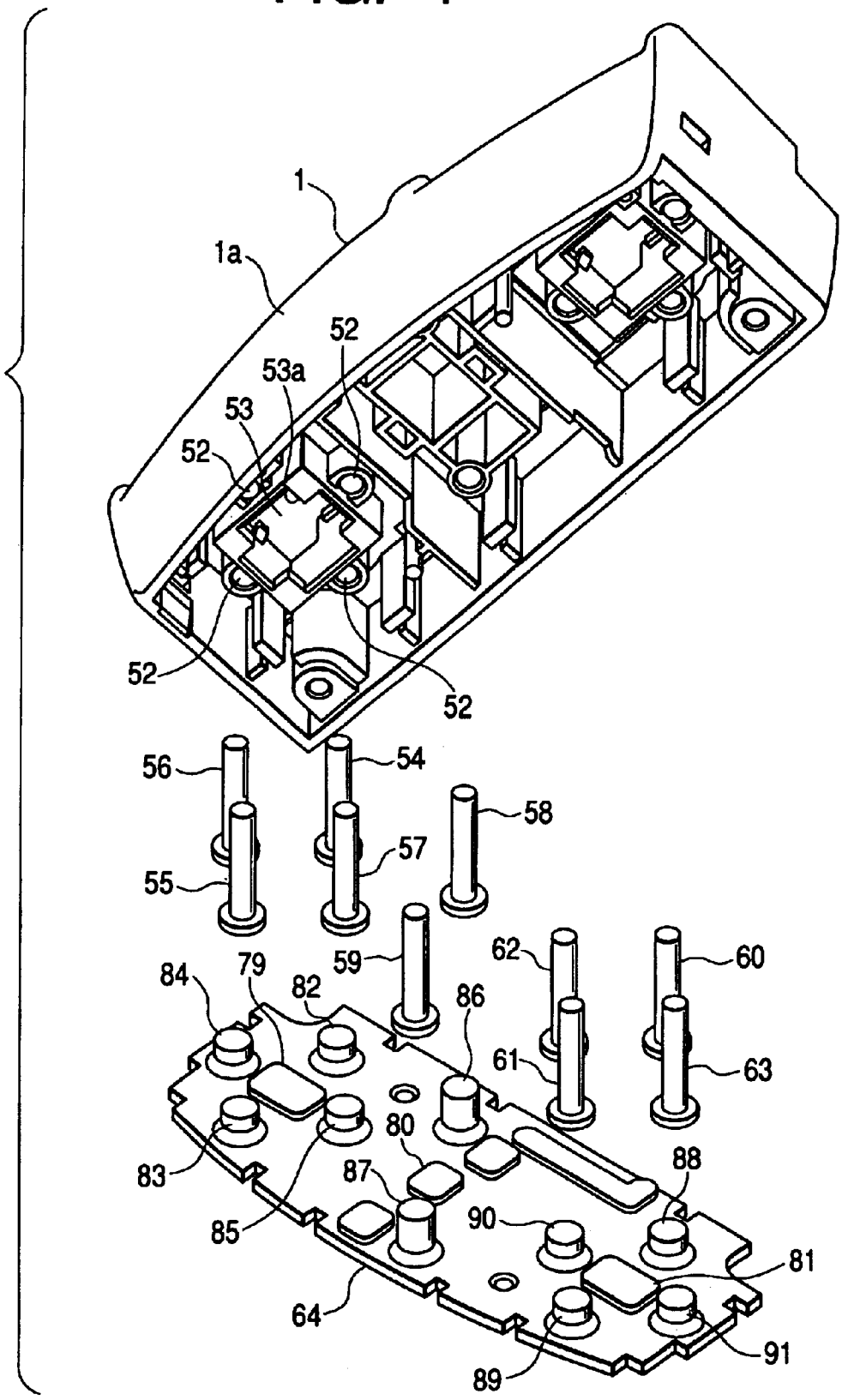
FIG. 4 is an exploded, perspective view showing another important portion.

The body 1 comprises an upper body portion 1*a* (shown in FIGS. 3 and 4), and a lower body portion 1*b* (shown in FIG. 5), and a generally-rectangular enclosure wall 48 is formed on an upper surface of the upper body portion 1*a* at left side portion as shown in FIG. 3, and a rectangular hole 49 is formed in a central portion of that portion of the upper surface enclosed by this enclosure wall 48. Support piece portions 50 are formed respectively at front and rear edges of the hole 49, and shaft projections 51 having a short cylindrical shape are formed respectively on inner surfaces of these support piece portions 50. Further, holes 52 are formed respectively at four portions (upper, lower, right and left portions) of that region surrounding the hole 49, and a cross-shaped opening 53 is formed at a bottom of the hole 49 as shown in FIG. 4.

In this construction, the main body portion 35*a* of the light guide member 35 is inserted into the hole 49 from the upper side, and is passed through the opening 53 in such a manner that this main body portion 35*a* can be pivotally moved, and the shaft receiving holes 46 formed respectively in the front and rear side walls of the holder 45 are pivotally fitted on the shaft projections 51, respectively. Pushers 54, 55, 56 and 57 each in the form of a round rod are passed respectively through the holes 52 from the lower side so as to slide upward and downward, as shown in FIG. 4, and these pushers 54 to 57 are disposed right beneath the operating projections 39 to 42 of the extension portions 35*b* to 35*e* of the light guide member 35 and hence right beneath the push operating portions 6 to 9 of the operating member 2. Pushers 58, 59, 60, 61, 62 and 63 for the operating members 3 and 4 are also shown in FIG. 4.

Figure 5:
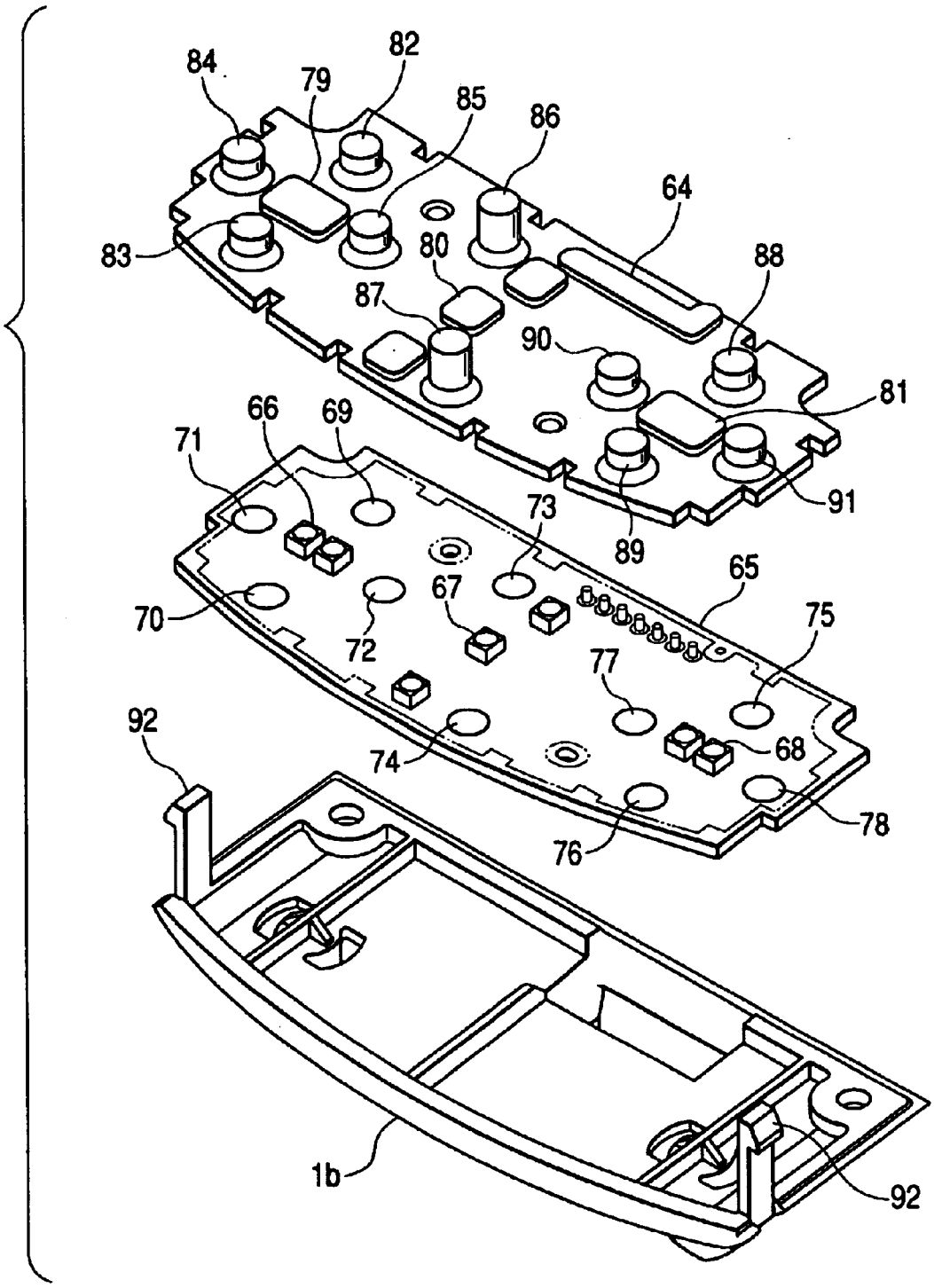
FIG. 5 is an exploded, perspective view showing a further important portion.

In FIG. 5, reference numeral 64 denotes a cover, and reference numeral 65 denotes a circuit board covered with this cover 64. Two light-emitting diodes (hereinafter referred to as "LED") 66 serving as a light source are mounted on a left side portion of the circuit board 65, and are juxtaposed in a right-left direction. Three LEDs 67 are mounted on a central portion of this circuit board, and are juxtaposed in a forward-rearward direction. Two LEDs 68 are mounted on a right side portion of this circuit board, and are juxtaposed in the right-left direction.

Fixed contacts 69, 70, 71 and 72 are mounted on the circuit board 65, and are arranged around the LEDs 66 to be disposed corresponding to the positions of the light-transmitting indicating portions 10 to 13 of the operating member 2, respectively. Fixed contacts 73 and 74 are mounted on the circuit board 65, and are arranged near to the LEDs 67 to be disposed corresponding to the positions of the light-transmitting indicating portions 17 and 18 of the operating member 3. Fixed contacts 75, 76, 77 and 78 are mounted on the circuit board 65, and are arranged around the LEDs 68 to be disposed corresponding to the positions of the light-transmitting indicating portions 25 to 28 of the operating member 4, respectively.

Although other necessary electronic parts are mounted on the circuit board 65, and necessary wiring patterns are formed on this circuit board, the showing and description of these parts will be omitted here.

Protuberances 79, 80 and 81 for respectively covering the LEDs 66, LEDs 67 and LEDs 68 are formed on the cover 64, and protuberances 82, 83, 84 and 85 for respectively covering the fixed contacts 69 to 72 are formed on the cover, and protuberances 86 and 87 for respectively covering the fixed contacts 73 and 74 are formed on the cover, and protuberances 88, 89, 90 and 91 for respectively covering the fixed contacts 75 to 78 are formed on the cover.

Each of the protuberances 79 to 81 allows light, emitted from the corresponding LEDs 66, 67, 68, to pass therethrough, and the protuberances 82 to 91 respectively contain movable contacts (not shown) which can be brought into and out of contact with the fixed contacts 69 to 78, respectively. The fixed contacts 69 to 78 and the movable contacts (the protuberances 82 to 91) form the respective switching elements. Each movable contact is brought into and out of contact with the corresponding fixed contact 69 to 78 under an elastic force of the corresponding protuberance 82 to 91 acting in the upward-downward direction. In this connection, the cover 64 is made of an elastic material having a light-transmitting nature such for example as substantially-transparent rubber.

Figure 1:
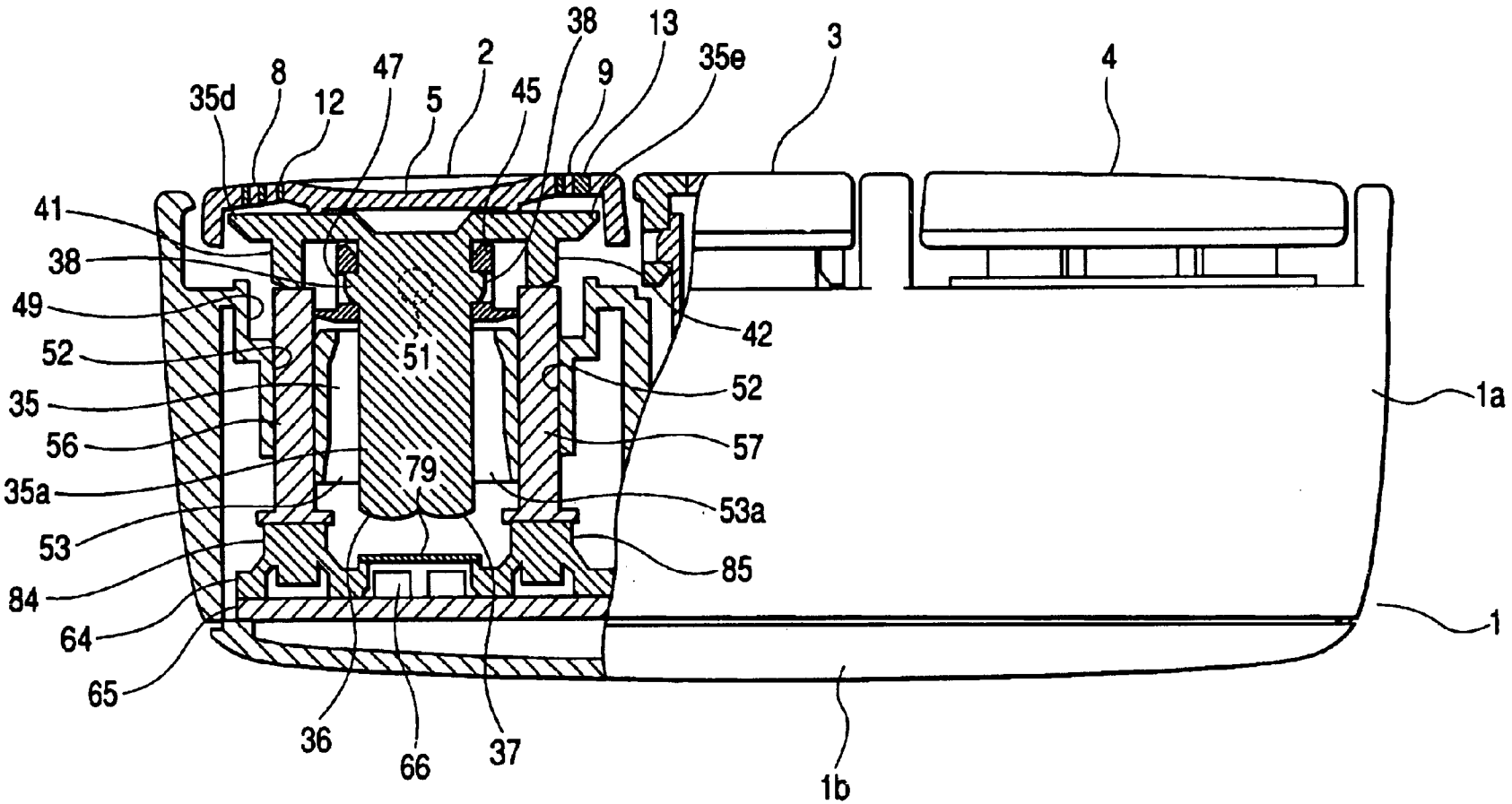
FIG. 1 is a partly-broken, front-elevational view of one preferred embodiment of the present invention.

The circuit board 65 and the cover 64, combined together, are attached to an open bottom portion (shown in FIG. 4) of the upper body portion 1*a*, so that the pushers 54 to 63 are disposed corresponding to the positions of the protuberances 82 to 91, respectively, and at the same time the main body portions (only the main body portion 35*a* is shown in FIG. 3) of the light guide members (only the light guide member 35 is shown in FIG. 3) are disposed corresponding to the positions of the protuberances 79 to 81 (the LEDs 66 to 68), respectively (see FIG. 1).

Thereafter, the lower body portion 1*b* (shown in FIG. 5) is connected to the upper body portion 1*a*. The lower body portion 1*b* has engagement claws 92 for effecting this connection.

Next, the operation of the above construction will be described, using the operating member 2 as a representative.

When the push operating portion 6 of the operating member 2 is pushed, the operating member 2 and the light guide member 35 are pivotally moved about the shaft projections 38 of the light guide member 35 (with the holder 45 serving as a bearing member), so that the operating projection 39 on the extension portion 35*b* depresses the pusher 54. The depressed pusher 54 pushes the protuberance 82 on the cover 64 at its lower end, so that the movable contact within the protuberance 82 is brought into contact with the fixed contact 69. As a result, the switching element constituted by the protuberance 82 (the movable contact) and the fixed contact 69 is pressed to be operated, and therefore one cruise control of the automobile is effected.

When the push operating portion 7 of the operating member 2 is pushed, the operating member 2 and the light guide member 35 are pivotally moved about the shaft projections 38 of the light guide member 35 (with the holder 45 serving as the bearing member) in a direction opposite to the above direction, so that the operating projection 40 on the extension portion 35*c* depresses the pusher 55. The depressed pusher 55 pushes the protuberance 83 on the cover 64 at its lower end, so that the movable contact within the protuberance 83 is brought into contact with the fixed contact 70. As a result, the switching element constituted by the protuberance 83 (the movable contact) and the fixed contact 70 is pressed to be operated, and therefore another cruise control of the automobile is effected.

When the push operating portion 8 of the operating member 2 is operated, the operating member 2 and the light guide member 35, together with the holder 45, are pivotally moved about the shaft projections 51 of the upper body portion 1*a* (with the support piece portions 50 serving as bearing members), so that the operating projection 41 on the extension portion 35*d* depresses the pusher 56. The depressed pusher 56 pushes the protuberance 84 on the cover 64 at its lower end, so that the movable contact within the protuberance 84 is brought into contact with the fixed contact 71. As a result, the switching element constituted by the protuberance 84 (the movable contact) and the fixed contact 71 is pressed to be operated, and therefore a further cruise control of the automobile is effected.

When the push operating portion 9 of the operating member 2 is operated, the operating member 2 and the light guide member 35, together with the holder 45, are pivotally moved about the shaft projections 51 of the upper body portion 1*a* (with the support piece portions 50 serving as the bearing members) in a direction opposite to the above direction, so that the operating projection 42 on the extension portion 35*e* depresses the pusher 57. The depressed pusher 57 pushes the protuberance 85 on the cover 64 at its lower end, so that the movable contact within the protuberance 85 is brought into contact with the fixed contact 72. As a result, the switching element constituted by the protuberance 85 (the movable contact) and the fixed contact 72 is pressed to be operated, and therefore a still further cruise control of the automobile is effected.

When each switching element is thus to be pressed to be operated, the main body portion 35*a* of the light guide member 35 moves along a peripheral edge 53*a* (see FIG. 4) of the cross-shaped opening 53 formed at the bottom of the hole 49 in the upper body portion 1*a*. Therefore, the peripheral edge 53*a* of the opening 53 functions as a guide member for guiding the light guide member 35 in the four directions corresponding respectively to the pushing operations of the push operating portions 6 to 9 of the operating member 2.

When the LEDs 66 to 68 emit light upon operation of a light control switch (not shown), for example, light emitted from the LEDs 66 passes through the main body portion 35*a* of the light guide portion 35 and then through the extension portions 35*b* to 35*e* to illuminate the light-transmitting indicating portions 10 to 13.

Here, the light guide member 35 is common to the four light-transmitting indicating portions 10 to 13 of the operating member 2, and in this connection the main body portion 35*a* is disposed at the central portion of the back side of the operating member 2. One reason for this is that each of the switching elements must be located at a position toward which the corresponding one of the push operating portions 6 to 9 is operated, so that an operating load produced upon pushing of each push operating portion 6 to 9 of the operating member 2 can be transmitted via the corresponding pusher 54 to 57 to the corresponding switching element without any loss, and another reason is that the switching elements can not be located at other positions than such positions because of a limited space, and therefore the light guide member need to be provided so as not to interfere with them. This arrangement is the same as that of the conventional construction.

Under the above circumstances, the light guide member 35 of this embodiment is made of a transparent material capable of sufficiently transmitting light. And besides, this light guide member 35 is separate from the light-transmitting indicating portions 10 to 13 of the operating member 2, and therefore the light-transmitting indicating portions 10 to 13 can be made of a translucent material regardless of the material of which the light guide member 35 is made. Therefore, each of the light-transmitting indicating portions 10 to 13 can be illuminated with the proper brightness by a sufficient amount of light passing through the light guide member 35 made of the transparent material, and the problems concerning the insufficient and excessive illumination, which have heretofore been considered, will not arise.

The present invention is not limited to the cruise-control and radio-control switch device, incorporated in the steering wheel of the vehicle (particularly an automobile), but can be applied to a wide variety of switches having similar problems with respect to their construction.

As described above, in the switch device of the present invention, the light guide member is provided such that it will not interfere with the pushers, operated respectively by the four push operating portions of the operating member, and the switching elements, and in this construction there is further achieved an excellent advantage that the light-transmitting indicating portions of the operating member can be properly illuminated.

What is claimed is:

1. A switch device comprising:

an operating member including push operating portions provided respectively at four portions of a peripheral portion thereof, and light-transmitting indicating portions provided respectively at the push operating portions;

a light guide member which is made of a transparent material, and is connected to the operating member, and includes a main body portion disposed at a back side of a central portion of the operating member, and extension portions which extend from the main body portion and are disposed respectively at back sides of the light-transmitting indicating portions;

a guide member for guiding the light guide member moved in four directions corresponding respectively in response to pushing operations of the push operating portions of the operating member;

pushers which are provided respectively at back sides of the extension portions of the light guide member, and can be pushed respectively by the pushing operations of the push operating portions;

switching elements which can be pressed and operated by the pushers, respectively; and a light source provided beyond the main body portion of the light guide member, wherein light emitted from the light source passes sequentially through the main body portion of the light guide member and the extension portions to illuminate the light-transmitting indicating portions of the operating member.

2. The switch device according to claim 1, wherein the light-transmitting indicating portions are made of translucent material.

* * * * *